US007832467B2

(12) United States Patent
Moser et al.

(10) Patent No.: US 7,832,467 B2
(45) Date of Patent: Nov. 16, 2010

(54) OIL COOLER

(75) Inventors: George Moser, Brighton, MI (US); Gordon Sommer, Plymouth, MI (US); Adam Ostapowicz, Westland, MI (US)

(73) Assignee: EDC Automotive, LLC, Auburn Hills, MI (US)

( * ) Notice: Subject to any disclaimer, the term of this patent is extended or adjusted under 35 U.S.C. 154(b) by 1106 days.

(21) Appl. No.: 11/214,473

(22) Filed: Aug. 29, 2005

(65) Prior Publication Data

US 2006/0060347 A1 Mar. 23, 2006

Related U.S. Application Data

(60) Provisional application No. 60/604,683, filed on Aug. 27, 2004.

(51) Int. Cl.
*G05D 23/00* (2006.01)

(52) U.S. Cl. ..... 165/297; 165/41; 165/51; 165/96; 165/103; 236/92 C

(58) Field of Classification Search ..... 165/41, 165/51, 52, 96, 97, 101, 102, 103, 296, 297, 165/298, 300; 236/34.5, 92 C
See application file for complete search history.

(56) References Cited

U.S. PATENT DOCUMENTS 3,920,067 A * 11/1975 Schindler et al. ..... 236/92 C
3,990,504 A * 11/1976 Kolthoff, Jr. ..... 165/97
4,337,737 A * 7/1982 Pechner ..... 165/300
4,593,749 A * 6/1986 Schatz ..... 165/101
5,152,144 A * 10/1992 Andrie ..... 165/296
5,242,011 A 9/1993 Hesse ..... 165/38
5,305,826 A * 4/1994 Couetoux ..... 236/34.5
6,019,171 A * 2/2000 Johnson ..... 165/297
6,499,666 B1 12/2002 Brown ..... 236/34.5
6,719,208 B2 4/2004 Brown ..... 236/34.5
6,935,569 B2 8/2005 Brown et al. ..... 236/34.5

* cited by examiner

*Primary Examiner*—Ljiljana (Lil) Ciric
(74) *Attorney, Agent, or Firm*—Harness, Dickey & Pierce, P.L.C.

(57) ABSTRACT

An oil cooler for a motor vehicle includes a fluid inlet tank and a fluid outlet tank. A plurality of heat transfer tubes provides constant fluid communication between the inlet tank and the outlet tank. A bypass arrangement provides additional fluid communication between the fluid inlet tank and the fluid outlet tank under a first operating condition and the bypass arrangement precludes additional fluid communication between the inlet tank and the outlet tank under a second operating condition. The bypass arrangement may include a bypass tube and an element for selectively blocking the bypass tube. The element for selectively blocking the bypass tube may be automatically response to a change in oil temperature or a change in oil pressure.

8 Claims, 6 Drawing Sheets

OIL COOLER

CROSS-REFERENCE TO RELATED APPLICATION

This application claims priority to U.S. Provisional Patent Application No. 60/604,683 filed Aug. 27, 2004. U.S. Provisional Patent Application No. is herein expressly incorporated by reference as set forth fully herein.

TECHNICAL FIELD

The present invention relates to the area of cooling of the fluids that are used in machinery such as engines, transmissions and other power equipment to lubricate components and/or transfer power. In one application, the present invention more particularly relates, but is not limited to, the area of cooling of transmission oil, engine oil, hydraulic oil or the like in automotive applications. Numerous other applications exist in diverse areas such as railways, ships, aircraft, machine tool, power generation equipment and others.

INTRODUCTION

A motor vehicle must be able to operate throughout a wide range of ambient temperatures. Fluids conventionally used in the automotive industry to lubricate components and transfer power are generally under significantly increased pressures during start up conditions, particularly at low ambient temperatures. Vehicle systems are required to cool these fluids. Such systems must also accommodate the upper limits of fluid pressures that may be experienced. The automotive engine oil reaches high temperatures during the operation of the engine. These high temperatures need to be reduced to avoid breakdown of the fluid. A device called an engine oil cooler is conventionally used for that purpose.

It is necessary to introduce considerable turbulence to the oil passing through these coolers to achieve the amount of cooling required in the limited space available. This turbulence is achieved by creating obstacles such as turbulators, convolutions or other hurdles to the flow of oil inside the oil cooler, which force the oil to repeatedly change direction. The turbulence increases the heat transfer, but it also causes a considerable pressure drop between the inlet oil and the outlet oil. This is particularly true when the oil is cold and becomes a serious problem at low temperatures (like most automotive components, the oil cooler must be able to operate reliably even at a temperatures of −40 degrees Fahrenheit). At such low temperatures the increased viscosity of the oil causes high pressures in the oil cooler, which can lead to burst, leaks and failure of the oil cooler and/or the lines that connect the oil cooler with the transmission.

Thus a need exists in the pertinent art for an oil cooler with a pressure limiting mechanism that protects the integrity of the oil cooler, the lines and the transmission.

SUMMARY

The teachings for the present invention provide an oil cooler for a motor vehicle. The oil cooler may include a fluid inlet tank and a fluid outlet tank. A plurality of heat transfer tubes provide constant fluid communication between the inlet tank and the outlet tank. A bypass arrangement selectively provides additional fluid communication between the fluid inlet tank and the fluid outlet. In this regard, the bypass arrangement provides additional fluid communication between the fluid inlet tank and the fluid outlet tank under a first operating condition and the bypass arrangement precludes additional fluid communication between the inlet tank and the outlet tank under a second operating condition. The bypass arrangement may include a bypass tube and means for selectively blocking the bypass tube. The means for selectively blocking the bypass tube may be automatically responsive to a change in oil temperature or a change in oil pressure.

The teachings of the present invention also provide a method of cooling oil of a cooler for a motor vehicle. The oil cooler includes a fluid inlet tank, a fluid outlet tank, and a plurality of heat transfer tubes providing constant fluid communication between the inlet tank and the outlet tank. The method includes providing a bypass arrangement for selectively providing additional fluid communication between the fluid inlet tank and the fluid outlet tank. The method additionally includes operating the cooler under a first operating condition such that the bypass arrangement provides additional fluid communication between the fluid inlet tank and the fluid outlet tank. The method further includes operating the cooler under a second operating condition such that the bypass arrangement precludes additional fluid communication between the inlet tank and the outlet tank under a second operating condition. Further areas of applicability of the present invention will become apparent from the detailed description provided hereinafter. It should be understood that the detailed description and specific examples are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of various aspects of the invention is merely exemplary in nature and is in no way intended to limit the invention, its application, or uses. The present teachings are applicable, but are not limited to, the area of cooling of transmission oil and/or engine oil in automotive applications. The present teachings are, for example, also applicable to diverse areas such as railways, ships, aircraft, machine tool, power generation equipment and others.

Figure 1:
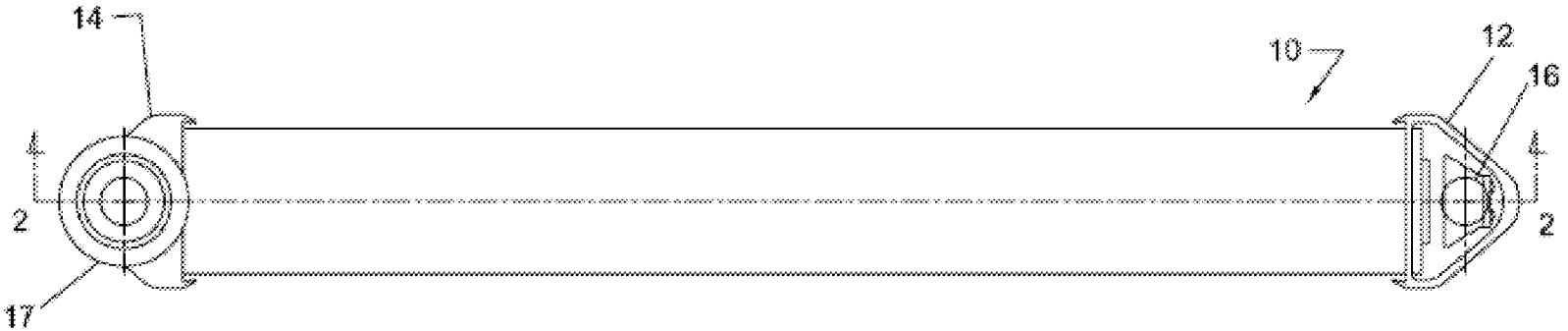
FIG. 1 is a top view of an oil cooler according to the teachings of the present teachings.
Figure 2:
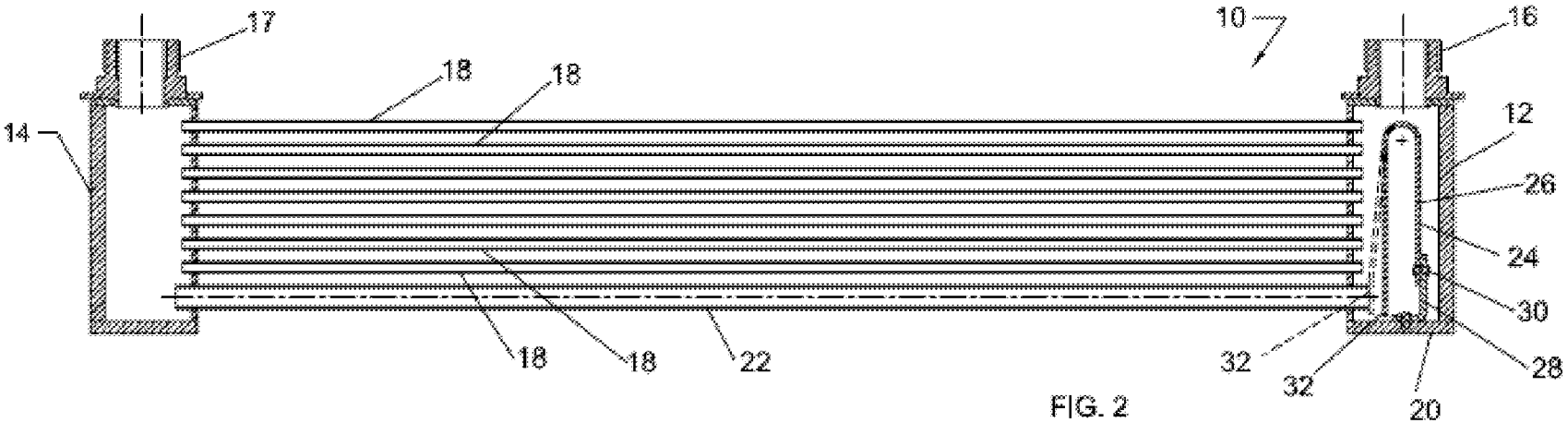
FIG. 2 is a cross-section view taken along the line 2-2 of FIG. 1.
Figure 2A:
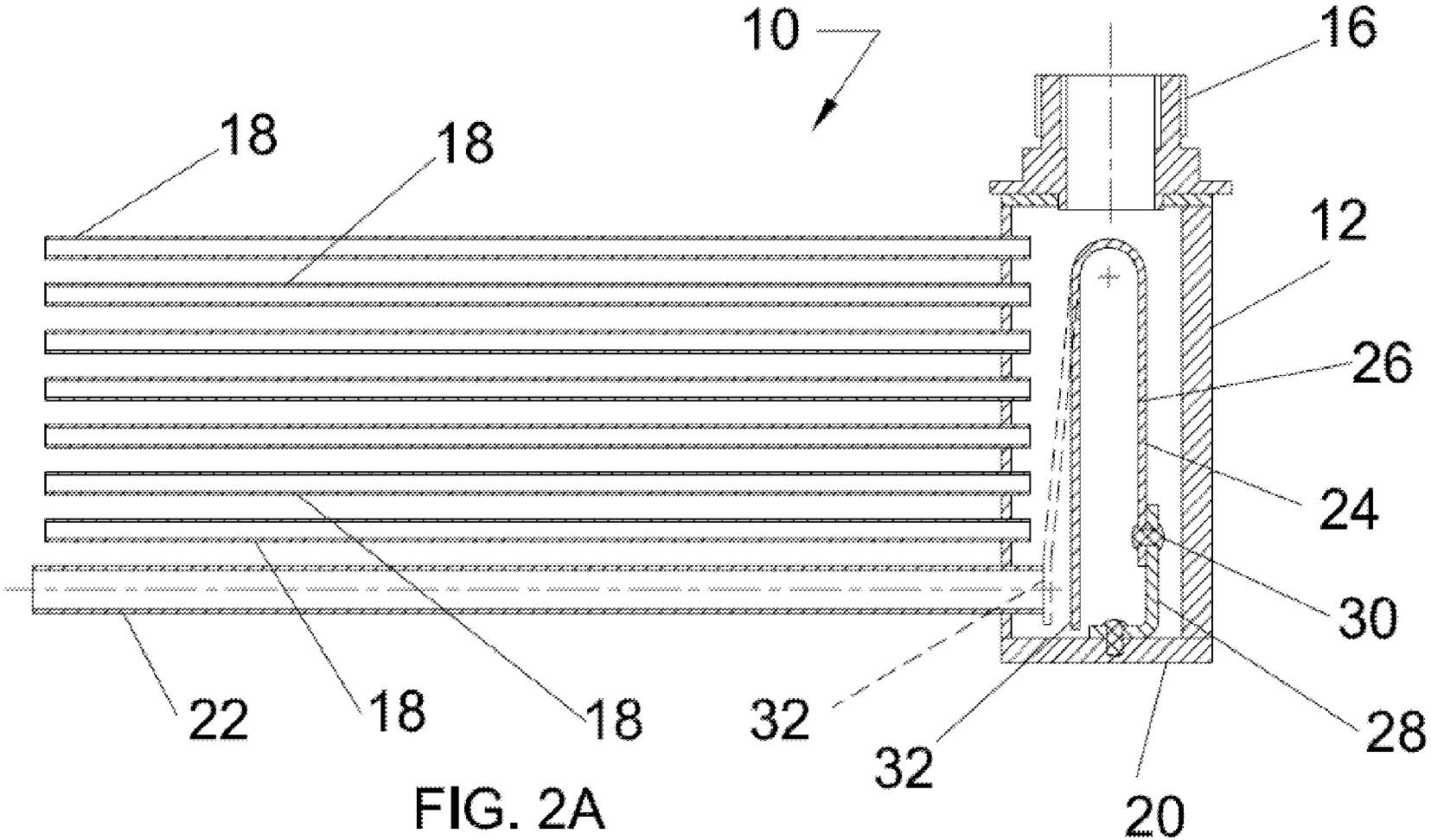
FIG. 2A is an enlarged view of a portion of FIG. 2.

With initial reference to FIGS. 1, 2, and 2A, an oil cooler in accordance with the teachings of the present invention is illustrated and generally identified at reference character 10. The oil cooler may be a transmission oil cooler, an engine oil cooler or a hydraulic fluid oil cooler, for example. The oil cooler 10 is shown to generally include a first tank or inlet fluid tank 12 and a second tank or outlet fluid tank 14. The inlet and outlet fluid tanks and 14 may be round, circular or of any suitable shape. The inlet fluid tank 12 is associated with an inlet port 16. The outlet tank 14 is associated with an outlet port 17. Typically, the inlet and outlet ports 16 and 17 may be threaded or equipped with some type of connector that allows the connection to the hydraulic lines leading the oil.

The inlet and outlet fluid tanks 12 and 14 may be connected by a plurality of heat transfer tubes 18. The heat transfer tubes 18 provide constant fluid communication between the inlet tank 12 and the outlet tank 14. In the exemplary illustration of FIG. 2, the plurality of heat transfer tubes 18 is shown to include five such tubes 18, although any number of tubes 18 can be used. The tubes 18 may be brazed or otherwise suitably attached to the inlet and outlet tanks 12 and 14.

The heat transfer tubes or cooling tubes may be configured in such a way as to provide a high degree of turbulence to the oil passing therethrough. As will be appreciated by those skilled in the art, such turbulence advantageously provides increased heat transfer within a limited space. When the oil is conventionally routed through the heat transfer tubes 18, there is a considerable drop in pressure between inlet and outlet oil. This drop in pressure becomes substantial when the oil is cold and more viscous.

The complete oil cooler 10 can be immersed in a cooling medium, such as radiator coolant, typically a mixture of 50% water and 50% glycol. The heat of the oil is transferred through the tube walls to the cooling medium, so that the temperature of the oil leaving the heat exchanger 10 is significantly lower than the temperature of the oil flowing into the heat exchanger 10. Insofar as the present invention is concerned, the inlet and outlet tanks 12 and 14 and the plurality of heat transfer tubes therebetween will be understood to be conventional in construction and operation.

With continued reference to the cross-sectional view of FIG. 2, the oil cooler 10 is further illustrated to include a bypass arrangement 20 for selectively providing additional fluid communication between the fluid inlet tank 12 and the fluid outlet tank 14. This fluid communication is in addition to the fluid communication constantly provided by the plurality of heat transfer tubes 18. The bypass arrangement 20 provides for the additional fluid communication between the inlet and outlet tanks 12 and 14 under a first operating condition and precludes or blocks the additional fluid communication between the inlet and outlet tanks 12 and 14 under a second operating condition. The first and second operating conditions may be dependent on the temperature of the oil in the inlet fluid tank 12.

The bypass arrangement 20 may include a bypass tube in fluid communication with the inlet and outlet tanks 12 and 14 and means for selectively blocking the bypass tube 20. As illustrated, the oil cooler 10 includes a single bypass tube 22. In other applications, the oil cooler 10 may include 2 or more bypass tubes 22 within the scope of the present invention. The bypass tube 22 may be brazed or otherwise suitably attached to the inlet and outlet tanks 12 and 14. In one application, the cross section of the bypass tube 22 may be elliptical in shape. Alternatively, the cross section of the bypass tube 22 may be oval, rectangular, round or any other desired shape. As will be appreciated below, the inside area of the bypass tube 22 may have substantially the same inside area as compared to the fittings and hose (not shown) attached to the inlet port 16.

The means for selectively blocking the bypass tube 20 may be automatically responsive for blocking the bypass tube in response to a predetermined condition. This predetermined condition may be reached upon a predetermined temperature of the oil in the inlet tank 12. For example, the means for automatically blocking the bypass tube may be responsive to block the bypass tube upon a predetermined oil temperature within the inlet tank 12. This predetermined temperature may be approximately 160 degrees Fahrenheit or any other identified temperature.

The means for selectively blocking the bypass tube 20 may include a temperature responsive valve 24. The temperature responsive valve 24 may include an element 26 movable between a first position and a second position in response to a change in temperature. The first position of the element 26 is shown in FIG. 2 in solid lines. In this first position, the element 26 is spaced from the bypass valve 24 and allows for the flow of oil between the inlet tank 12 and the outlet tank 14. The second position is shown in FIG. 2 in phantom lines and operates to prevent oil from passing through the bypass tube 22.

The element 26 of the temperature responsive valve 24 may be a bi-metal element 26. The bi-metal element 26 may be a U-shaped strip. The bi-metal element 26 may be disposed in the inlet tank 12 and secured to the inlet tank 12 with a bracket 28. Attachment of the element 26 to the bracket 28 may be accomplished with rivets 30 or other suitable means, including but not limited to brazing. When the inlet oil temperature is below the predetermined temperature, the bi-metal element 26 is in the first position. In this position, a very small increase in inlet pressure is required to facilitate flow from the inlet tank 12 to the outlet tank 14 through the bypass valve 24 given the similarity in inside area between the bypass tube 22 and the fittings and hose of the inlet tank 12. Because the bypass arrangement 20 controls the maximum oil pressure of the oil cooler 10, conventional hoses and fittings do not need to be as heavy. When most of the oil flow is through the bypass tube 22 rather than the heat exchange tubes 18, the oil temperature rises to an optimum operating temperature more quickly. In this manner, the disadvantages of cold starts are overcome.

When the oil temperature in the inlet tank 12 reaches the predetermined temperature, the bi-metal element 26 moves to the second position. In this second position, an end 32 of the bi-metal element 26 covers an end of the bypass tube 22 thereby blocking the flow of oil through the bypass tube 22. The oil is resultantly routed through the heat exchange tubes 18 for cooling. It will be appreciated by those skilled in the art that the properties of the bi-metal element 26 may be selected in a conventional manner to attain closure of the bypass tube 22 at a particular temperature.

Figure 3:
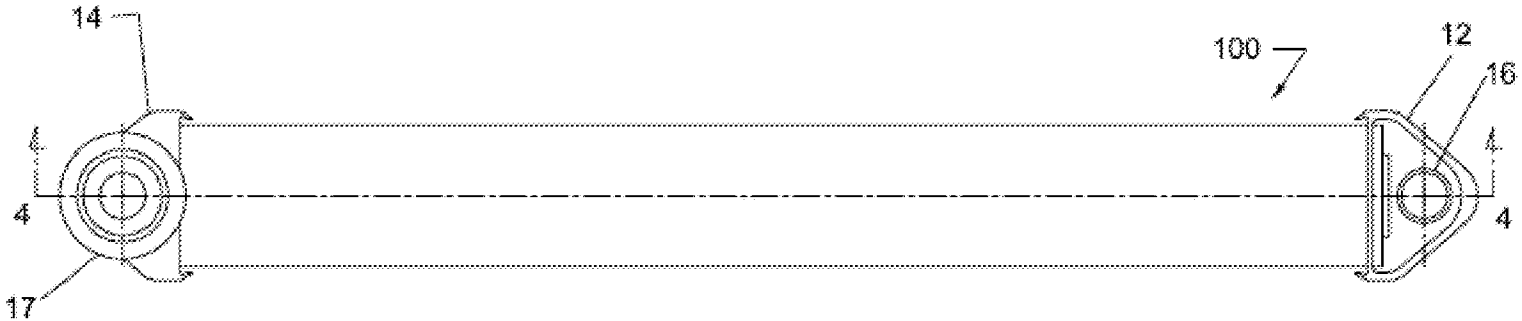
FIG. 3 is a top view of another oil cooler according to the teachings of the present invention.
Figure 4:
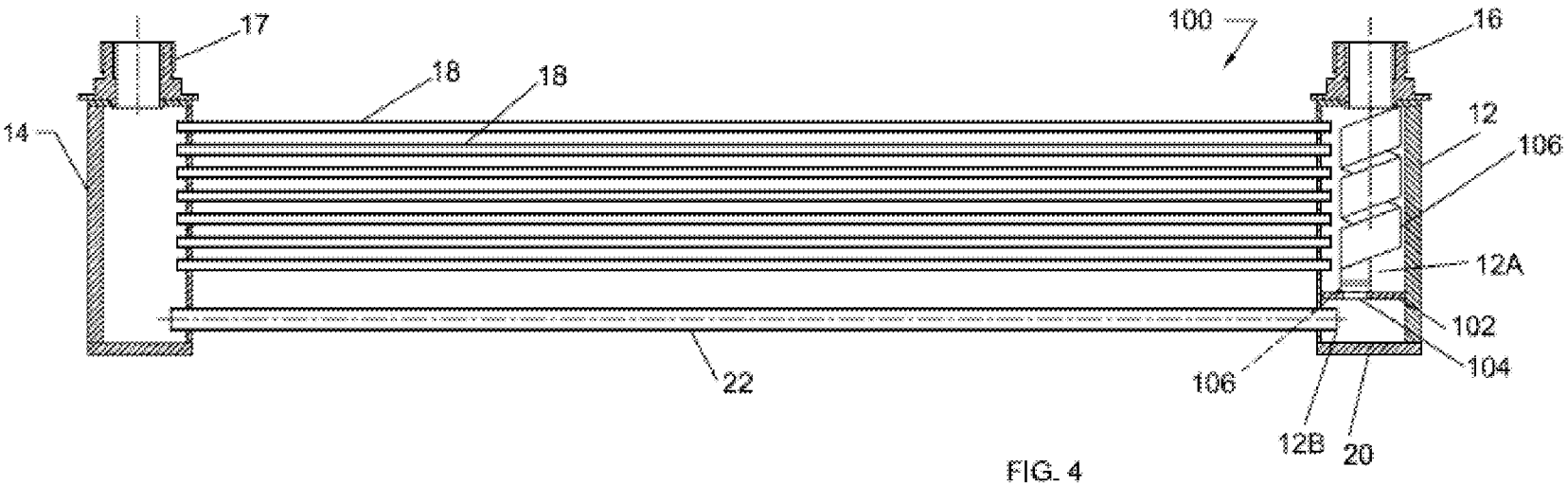
FIG. 4 is a cross-section view taken along the line 4-4 of FIG. 3.
Figure 4A:
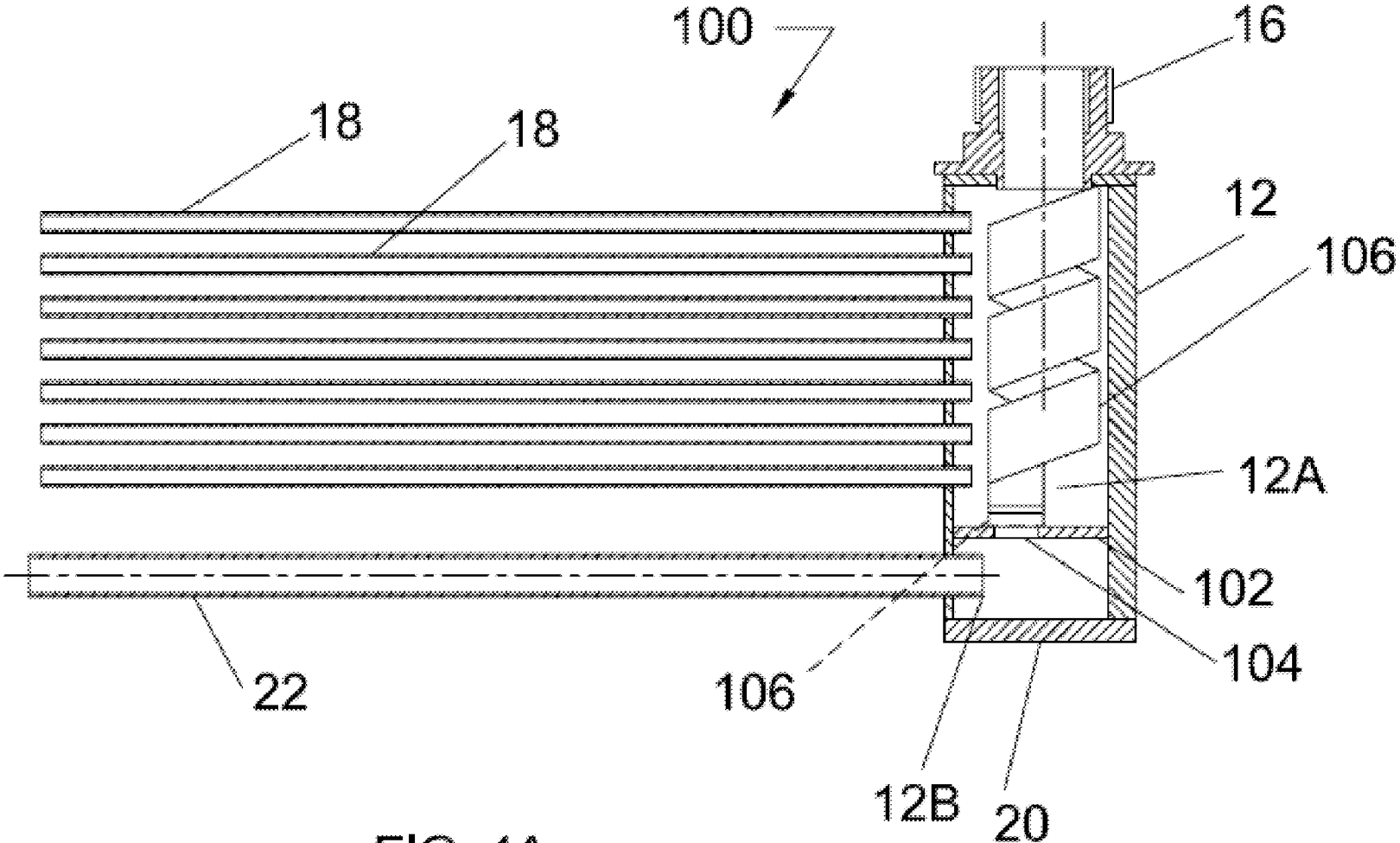
FIG. 4A is an enlarged view of a portion of FIG. 4.

Turning to FIGS. 3, 4, and 4A, another embodiment of an oil cooler according to the teachings of the present invention is illustrated. This embodiment is generally identified at reference character 100. Given the similarities between the oil cooler 100 and the previously described oil cooler 10, like reference numbers will be used to denote similar elements. The oil cooler 100 differs from the oil cooler 10 by incorporating an alternate means for selectively blocking the bypass tube 20.

As illustrated in the cross-sectional view of FIG. 4, the inlet tank 12 may include a primary chamber 12A and a secondary chamber 12B. The primary chamber 12A is in constant fluid communication with the inlet port 16. The plurality of heat transfer tubes are in constant fluid communication with the primary chamber 12A. The bypass tube 22 is in constant communication with the secondary chamber 12B. The means for selectively blocking the bypass tube 20 may include a wall or baffle 102 partitioning the primary chamber 12A from the secondary chamber 12B. The wall may include an orifice 104 from providing communication between the primary and secondary chambers 12A and 12B. The means for selectively blocking the bypass tube 20 may include a movable element 106 for opening and closing the orifice 104. The element 106 may be movable between a first position and a second position in response to a change in temperature. The first position of the element 106 is shown in FIG. 4 in solid lines. In this first position, the element 106 is spaced from the orifice 104 and allows for the flow of oil from the primary chamber 12A to the secondary chamber 12B. The second position is shown in FIG. 4 in phantom lines and operates to prevent oil from the primary chamber 12A to the secondary chamber 12B.

The element 106 may be a bi-metal element in the shape of a helix. Alternatively, the bi-metal element 106 may be in the shape of a cantilevered straight beam, a U-beam, a spiral coil or any other suitable shape. At a first predetermined inlet oil temperature, the element 106 starts to close the orifice 104. The orifice 104 becomes fully closed at a second predetermined inlet oil temperature.

Figure 5:
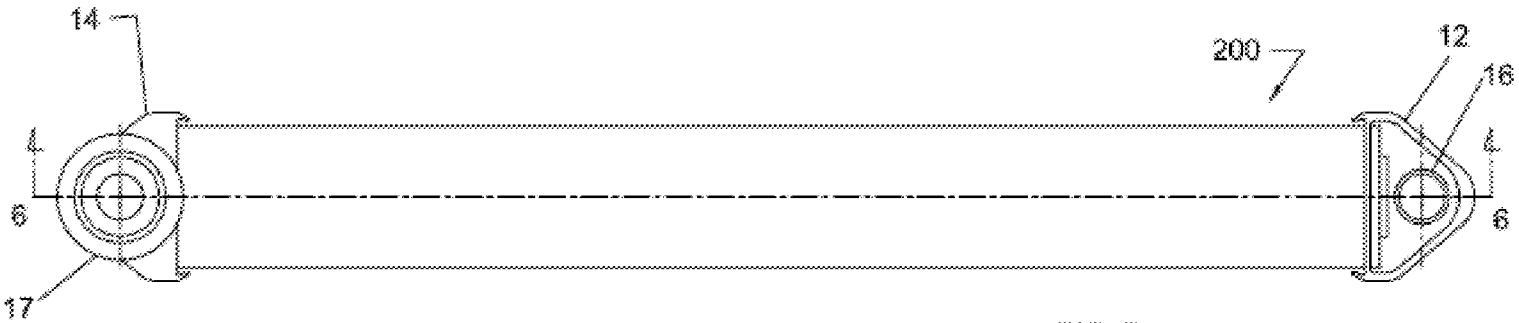
FIG. 5 is a top view of another oil cooler according to the teachings of the present invention.
Figure 6:
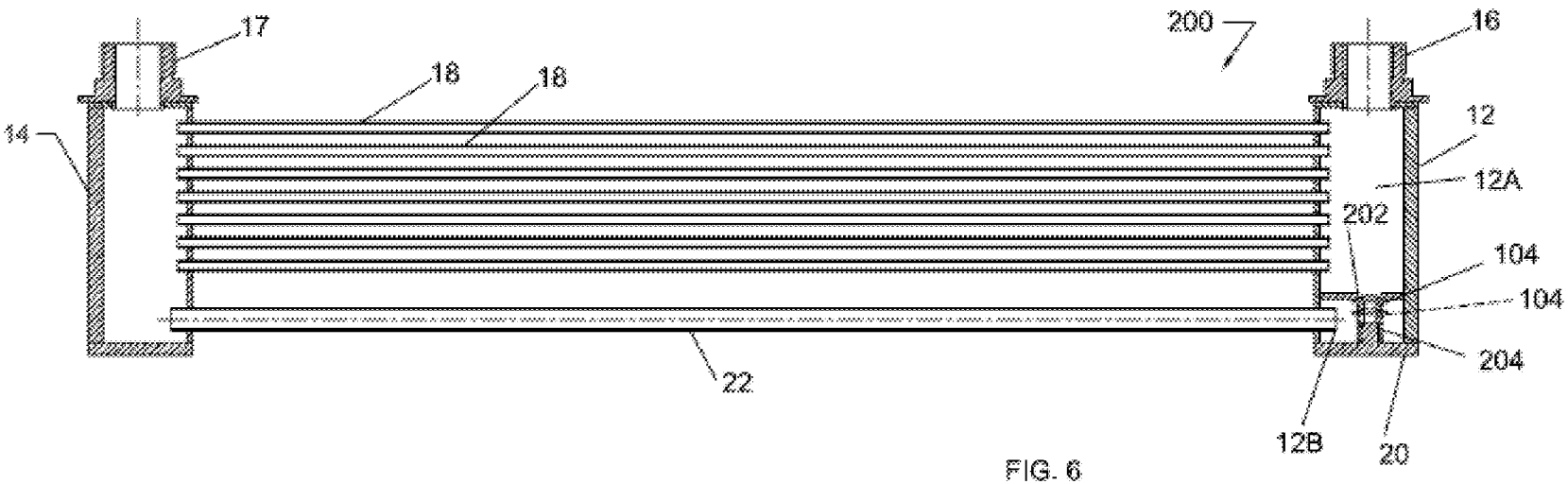
FIG. 6 is a cross-section view taken along the line 6-6 of FIG. 5.
Figure 6A:
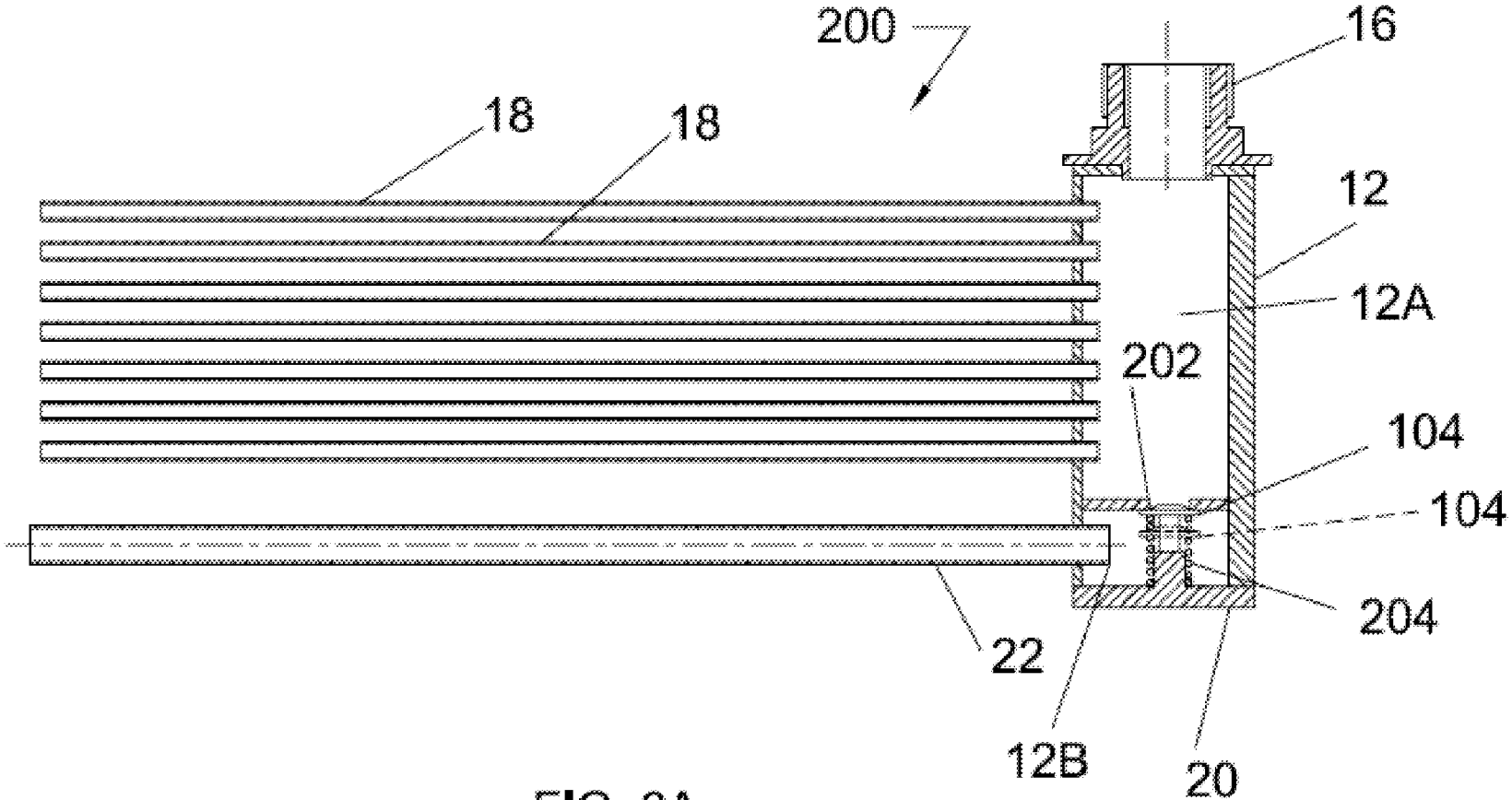
FIG. 6A is an enlarged view of a portion of FIG. 6.

Turning to FIGS. 5, 6, and 6A, another embodiment of an oil cooler according to the teachings of the present invention is illustrated. This embodiment is generally identified at reference character 200. Again given the similarities between the oil cooler 200 and the previously described embodiments, like reference numbers will be used to denote similar elements. The oil cooler 200 differs from the oil cooler 10 by incorporating an alternate means for selectively blocking the bypass tube 20.

As illustrated in the cross-sectional view of FIG. 6, the inlet tank 12 may include a primary chamber 12A and a secondary chamber 12B. The primary chamber 12A is in constant fluid communication with the inlet port 16. The plurality of heat transfer tubes are in constant fluid communication with the primary chamber 12A. The bypass tube 22 is in constant communication with the secondary chamber 12B. The means for selectively blocking the bypass tube 20 may include a wall or baffle 102 partitioning the primary chamber 12A from the secondary chamber 12B. The wall 102 may include an orifice 104 from providing communication between the primary and secondary chambers 12A and 12B. The means for selectively blocking the bypass tube 20 may include a valve 202 for opening and closing the orifice 104. The element 106 may be movable between a first position and a second position in response to a change in pressure. The first position of the valve 202 is shown in FIG. 6 in solid lines. In this first position, the valve 202 is adjacent the orifice 104 and prevents the flow of oil from the primary chamber 12A to the secondary chamber 12B. The second position is shown in FIG. 6 in phantom lines. In this position, the valve 202 permits oil to flow from the primary chamber 12A to the secondary chamber 12B.

The valve 202 may be controlled by a spring 204. The spring 204 may circumferentially surround a post extending into the secondary chamber 12B of the inlet fluid tank 12. The spring 204 normally urges the valve 202 to the first or closed position. When the inlet oil pressure is greater than the force of the spring 204, the valve 202 is displaced downwardly and no longer closes the orifice 104. In this manner, the system pressure of the oil cooler 200 is limited.

It will now be appreciated that the teachings of the present invention provide an oil cooler that limits the pressure of the oil flowing through its cooling tubes. The additional present invention provides a pressure-limiting system based on a simple, inexpensive and durable bypass mechanism. Further, the present invention provides a bypass system that automatically responds to the lower temperatures, as well as an alternate system that bypasses the oil based upon the pressure of the inlet oil to the oil cooler. Still yet further, the present invention provides an oil cooler that will allow the vehicle's transmission to reach optimum operating temperature more quickly than with conventional oil coolers.

The foregoing discussion discloses and describes merely exemplary arrangements of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An oil cooler for cooling oil of a motor vehicle, the oil cooler comprising:

a fluid inlet tank;

a fluid outlet tank;

a plurality of heat transfer tubes providing constant fluid communication between the inlet tank and the outlet tank; and at least one bypass tube for selectively providing additional fluid communication between the fluid inlet tank and the fluid outlet tank; and a bi-metallic valve moveable from a first position to a second position in response to an increase in temperature of the oil such that the valve member closes the at least one bypass tube to preclude additional fluid communication between the fluid inlet tank and the fluid outlet tank when the valve member is in the second position and the valve member opens the bypass tube to provide additional fluid communication between the inlet tank and the outlet tank in the first position.

2. The oil cooler of claim 1, wherein the valve member is a temperature responsive valve.

3. The oil cooler of claim 2, where the temperature responsive valve includes a bi-metal element movable from the first position to the second position in response to a change in temperature.

4. The oil cooler of claim 3, wherein the bi-metal element is a strip that is generally U-shaped.

5. The heat exchanger of claim 3, wherein the bi-metal element is a strip shaped in the form of a curved or a convoluted beam.

6. The oil cooler of claim 1, wherein the oil cooler is a transmission oil cooler.

7. The oil cooler of claim 1, wherein the oil cooler is an engine oil cooler.

8. A method of cooling oil of a cooler for a motor vehicle, the oil cooler including a fluid inlet tank, a fluid outlet tank, and a plurality of heat transfer tubes providing constant fluid communication between the inlet tank and the outlet tank, the method including:

providing a bypass arrangement for selectively providing additional fluid communication between the fluid inlet tank and the fluid outlet tank;

operating the cooler under a first operating condition wherein the temperature of the oil is below a predetermined temperature and the bypass arrangement provides additional fluid communication between the fluid inlet tank and the fluid outlet tank; and operating the cooler under a second operating condition wherein the temperature of the oil is above the predetermined temperature and the bypass arrangement precludes additional fluid communication between the inlet tank and the outlet tank under a second operating condition.

* * * * *